US012768154B1

(12) United States Patent
Osmond et al.

(10) Patent No.: US 12,768,154 B1
(45) Date of Patent: Oct. 20, 2026

(54) DOUBLE SINK OVERFLOW PROTECTION

(71) Applicants: Wade Osmond, Benton (CA); Darrell Osmond, Westlock (CA)

(72) Inventors: Wade Osmond, Benton (CA); Darrell Osmond, Westlock (CA)

( * ) Notice: Subject to any disclaimer, the term of this patent is extended or adjusted under 35 U.S.C. 154(b) by 96 days.

(21) Appl. No.: 18/808,039

(22) Filed: Aug. 18, 2024

(51) Int. Cl.
*E03C 1/24* (2006.01)

(52) U.S. Cl.
CPC ..... *E03C 1/24* (2013.01)

(58) Field of Classification Search
CPC ..... F16L 5/02; F16L 5/06; F16L 5/08; F16L 5/10; F16L 5/14; F16L 25/028; F16L 25/023; F16L 25/025; F16L 47/26; F16L 47/28; F16L 47/34; F16L 41/001; F16L 41/005; F16L 41/088; F16L 41/14; F16L 59/121; F16L 58/188; F16L 58/184; E03C 1/24
USPC ..... 4/640, 651, 694, 695
See application file for complete search history.

(56) References Cited

U.S. PATENT DOCUMENTS

| | | | | |
|---|---|---|---|---|
| 2,036,692 | A | 4/1936 | Groeniger | |
| 4,624,020 | A | 11/1986 | Abderhalden et al. | |
| 4,998,306 | A | 3/1991 | Klimke et al. | |
| 2004/0250345 | A1 | 12/2004 | Kaster | |
| 2007/0261164 | A1 | 11/2007 | Martin et al. | |
| 2015/0128339 | A1 | 5/2015 | Warner | |
| 2020/0096138 | A1* | 3/2020 | Bean | F16L 33/224 |

* cited by examiner

*Primary Examiner* — Aaron M Dunwoody
(74) *Attorney, Agent, or Firm* — Gugliotta & Gugliotta LPA

(57) ABSTRACT

A device and method for preventing water overflow in double-sided sinks is provided. The invention includes a pipe nipple with threaded ends, plastic nuts, and rubber O-rings that can be easily installed in the divider wall of double sinks. This system redirects excess water from one basin to the other, preventing spills onto the floor and ensuring efficient water management. The device is cost-effective, universally adaptable, and easy to install, making it a practical solution for preventing water overflow in various sink environments.

10 Claims, 6 Drawing Sheets

DOUBLE SINK OVERFLOW PROTECTION

CROSS-REFERENCE TO RELATED APPLICATIONS

There are no previously filed, nor currently any co-pending applications, anywhere in the world.

BACKGROUND OF THE INVENTION

1. Field of the Invention

The present invention relates generally to sink overflow adapters and, more specifically, to a device and method for preventing water overflow in double-sided sinks by redirecting excess water from one basin to the other, ensuring efficient water management and preventing spills onto the floor.

2. Description of the Related Art

Double-sided sinks are commonly used in kitchens, laundry rooms, garages, and various other settings for their convenience and functionality. However, a prevalent issue with these sinks is the potential for water to overflow from one basin to spill onto the floor when only one side is in use. This can occur when the water level rises in one basin due to an obstruction or heavy use, while the other basin remains empty and underutilized.

Existing double-sided sinks often lack an efficient built-in mechanism to redirect overflow water from one basin to the other. As a result, users must resort to makeshift solutions such as using wet vacuums, siphon systems, or manually bailing out the water, which are inconvenient and time-consuming.

Some modern sinks come with built-in overflow protection, but these are typically more expensive and may not be available for older sink models. Retrofitting such systems into existing sinks can be complex and costly, requiring professional installation and potentially extensive modifications.

Many available solutions for overflow protection may not blend well aesthetically with existing sink designs, and their installation may compromise the sink's functionality or appearance. Current overflow protection devices, if available, often require specialized knowledge and tools for installation, making them inaccessible to the average do-it-yourselfer.

Therefore, there is a clear need for a simple, cost-effective, and universally adaptable solution that can be easily installed in any double-sided sink to prevent overflow. Such a solution should be easy to install, aesthetically pleasing, and effective in redirecting excess water from one basin to the other, ensuring that water does not spill onto the floor. This innovation addresses these needs, providing a practical and user-friendly solution to a common problem faced by many homeowners and facility managers.

SUMMARY OF THE INVENTION

It is thus an object of the present invention to provide a simple, cost-effective, and universally adaptable device for preventing water overflow in double-sided sinks by redirecting excess water from one basin to the other, thereby preventing spills and water damage.

It is a further feature of the present invention to provide a device consisting of a pipe nipple with threaded ends, plastic nuts, and rubber O-rings that can be easily installed in the divider wall of double-sided sinks. This device prevents water overflow by redirecting excess water from one basin to the other, ensuring efficient water management and preventing spills onto the floor.

The present invention provides an overflow protection device adapted to prevent water from overflowing from one basin of a double-sided sink to the floor by redirecting excess water into the other basin. This innovative solution is suitable for use in kitchens, laundry rooms, garages, and other settings with double sinks. The device comprises a hollow cylindrical pipe nipple with threaded ends, plastic nuts for securing the nipple, and rubber O-rings for ensuring a watertight seal between the pipe nipple and the sink divider wall. This configuration effectively prevents water from overflowing onto the floor, fitting a wide variety of double-sided sink styles and sizes. The device is easy to install by a do-it-yourselfer without specialized tools, cost-effective due to the use of readily available materials, and designed to blend seamlessly with the sink's appearance. The durable construction ensures long-lasting performance, enhancing the overall functionality of double sinks. By preventing water damage to floors and cabinetry, the device saves time and money on repairs. The installation process involves drilling a hole through the sink divider wall, inserting the pipe nipple, placing the rubber O-rings, securing with plastic nuts, and tightening to ensure a watertight seal.

This simple yet effective design addresses a common problem, making the device eligible for patent protection due to its novelty, non-obviousness, and practical application.

It is an advantage of the present invention that it provides a simple and effective solution to prevent water overflow in double-sided sinks.

Another advantage of the present invention is that it is cost-effective, utilizing readily available materials to keep production and installation costs low.

It is an advantage of the present invention that it is universally adaptable, fitting a wide variety of double sink styles and sizes.

It is another advantage of the present invention that it features a straightforward installation process that can be performed by a do-it-yourselfer without the need for specialized tools.

It is an advantage of the present invention that it prevents water damage to floors and cabinetry by redirecting excess water from one basin to the other.

It is another advantage of the present invention that it eliminates the need for makeshift overflow solutions such as wet vacuums or siphon systems.

It is an advantage of the present invention that it maintains the aesthetic appeal of the sink, with components designed to blend seamlessly with various sink designs.

It is another advantage of the present invention that it enhances the functionality of existing sinks, making them more reliable and user-friendly.

It is an advantage of the present invention that it is durable, using sturdy materials that ensure long-lasting performance.

Another advantage of the present invention is that it can be installed in both new and existing double-sided sinks, providing flexibility and convenience for various applications.

Further features of the invention will become apparent in the course of the following description.

BRIEF DESCRIPTION OF DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
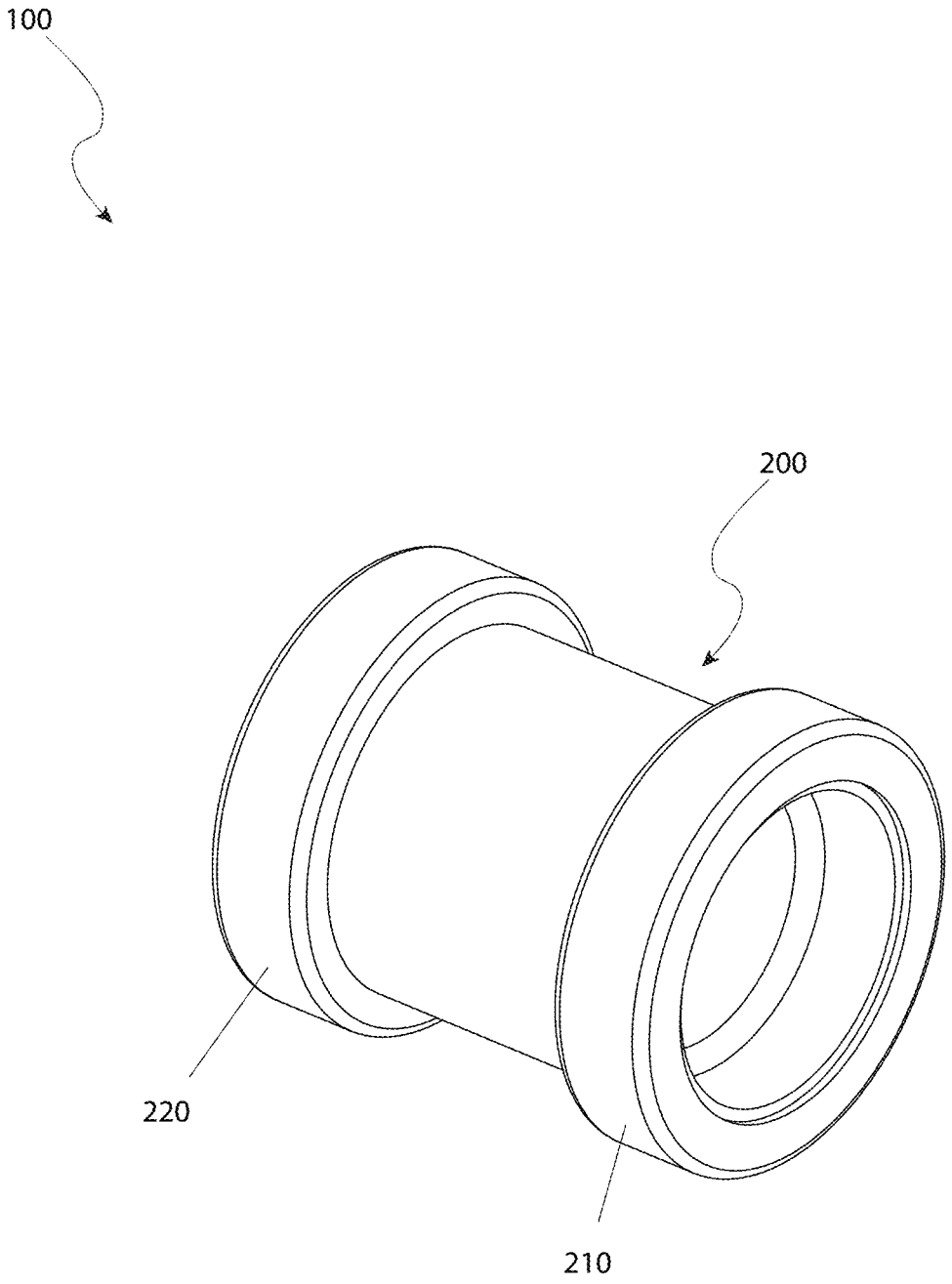
FIG. 1 is an isometric view of an overflow protection adapter 100, according to a preferred embodiment of the present invention.
Figure 2:
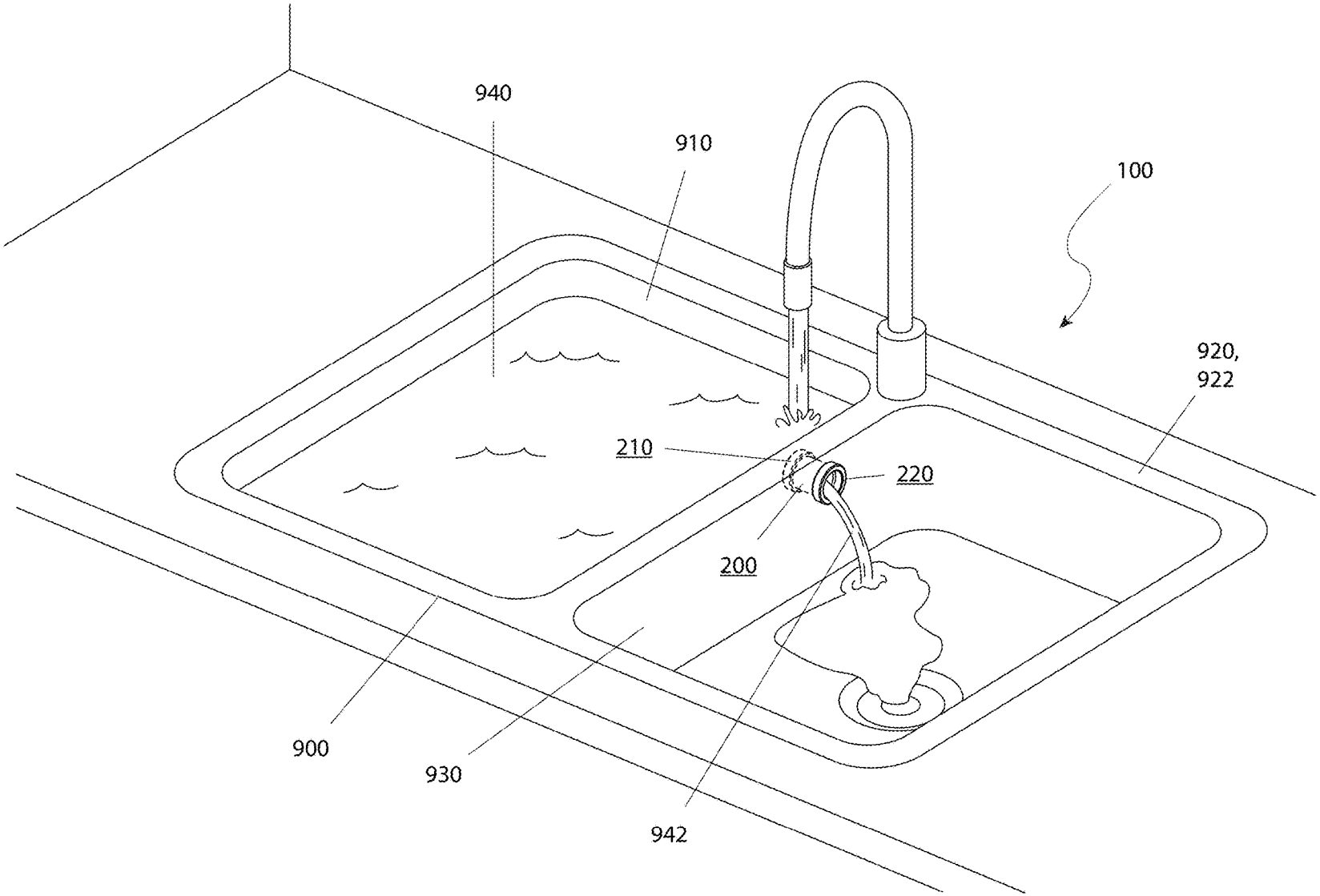
FIG. 2 is an in-use view of an overflow protection adapter 100, according to the preferred embodiment of the present invention.
Figure 3:
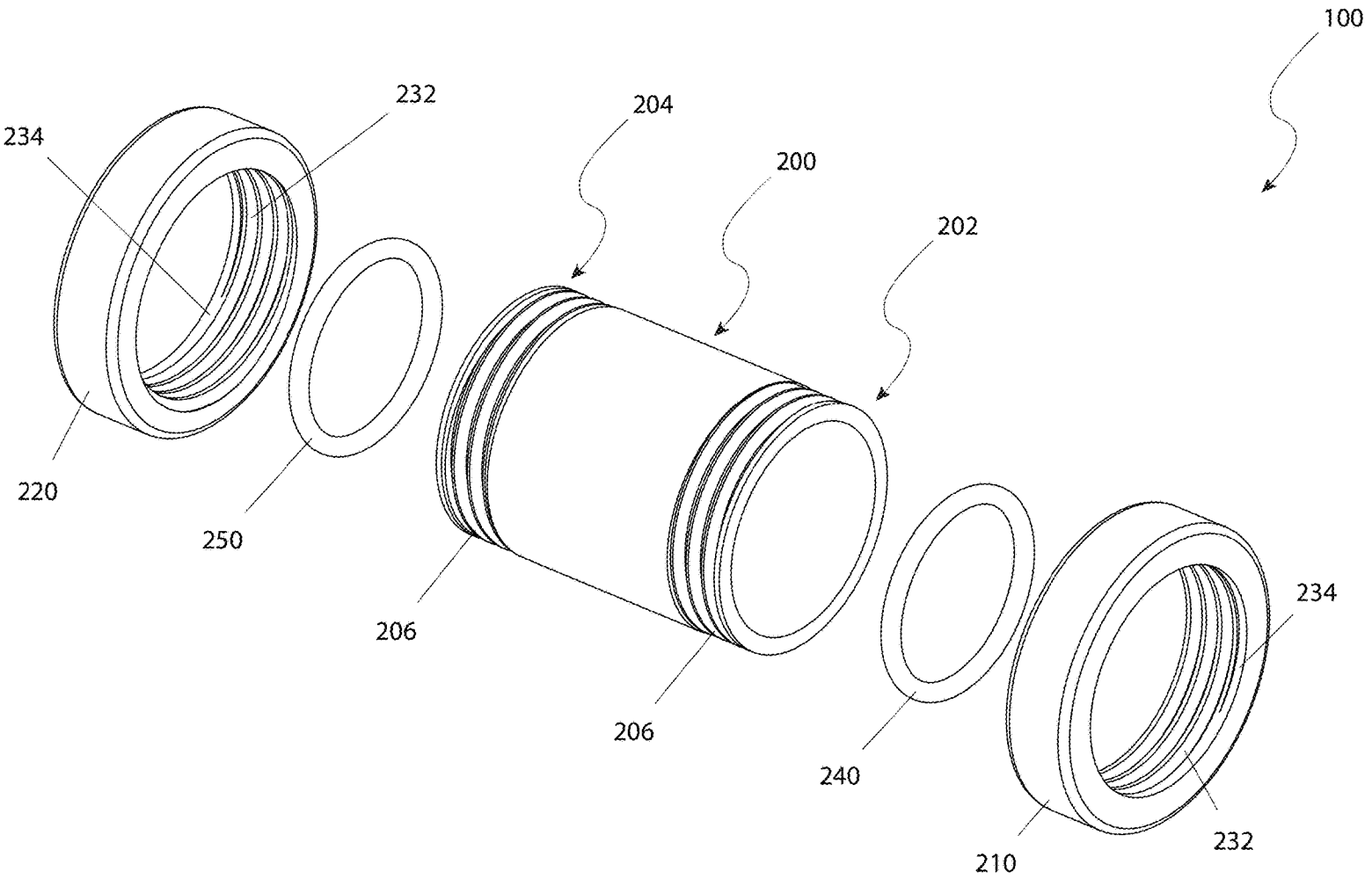
FIG. 3 is an exploded view of an overflow protection adapter 100, according to the preferred embodiment of the present invention.
Figure 4:
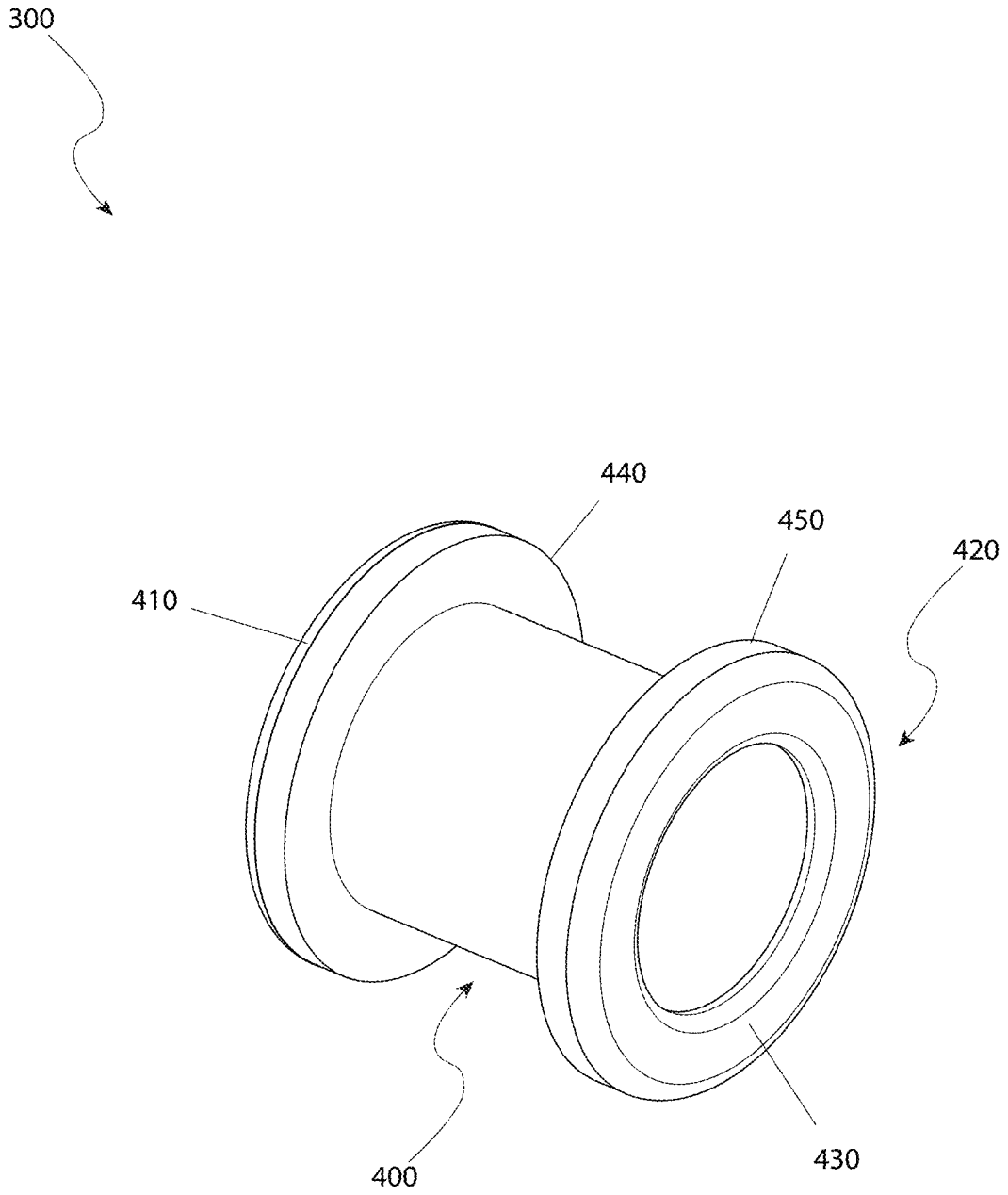
FIG. 4 is an isometric view of an alternate overflow protection adapter 300, according to an alternate embodiment of the present invention.
Figure 5:
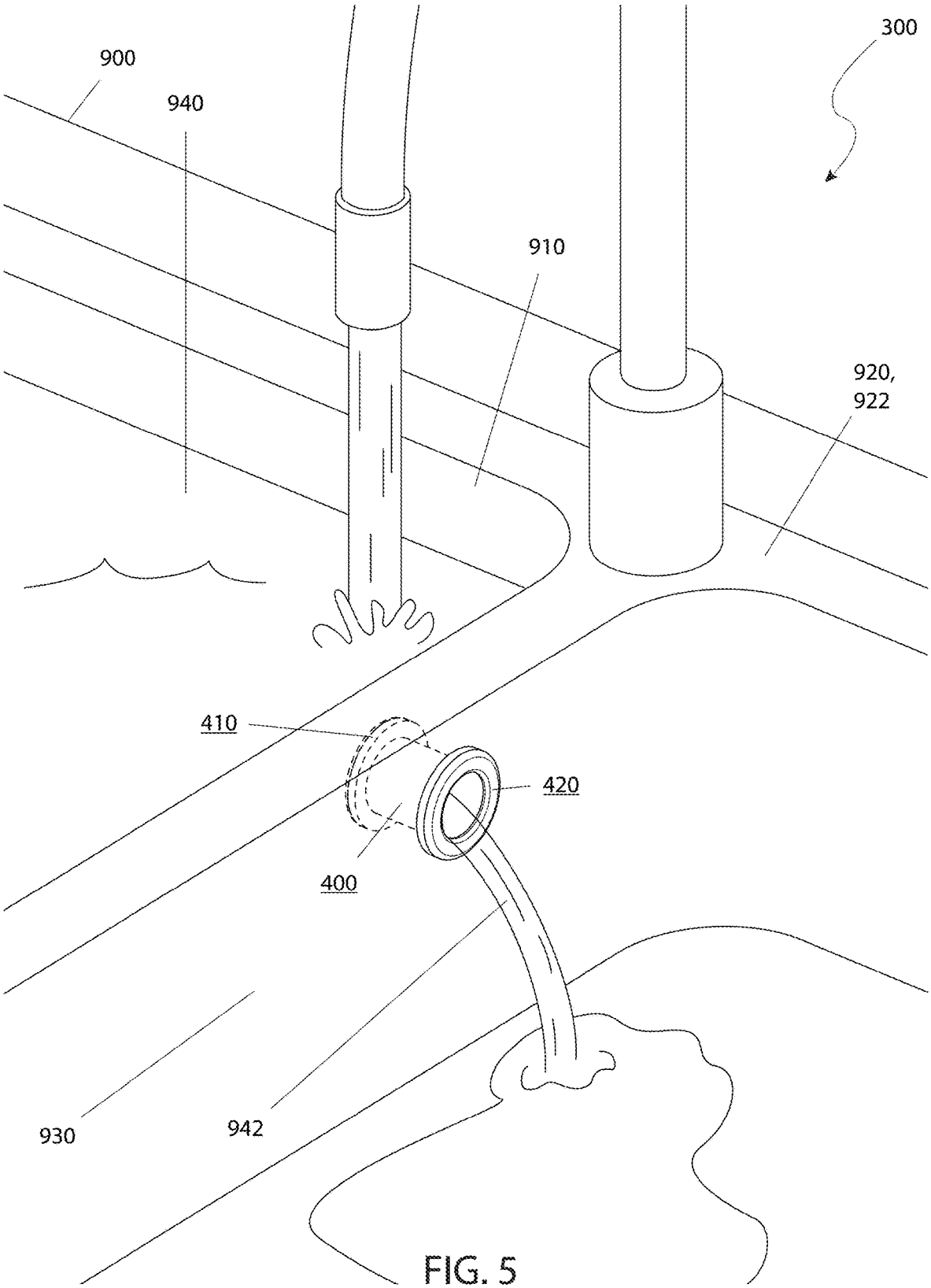
FIG. 5 is an in-use view of an alternate overflow protection adapter 300, according to the alternate embodiment of the present invention; and, FIG. 6 is an exploded view of an alternate overflow protection adapter 300, according to the alternate embodiment of the present invention.
Figure 6:
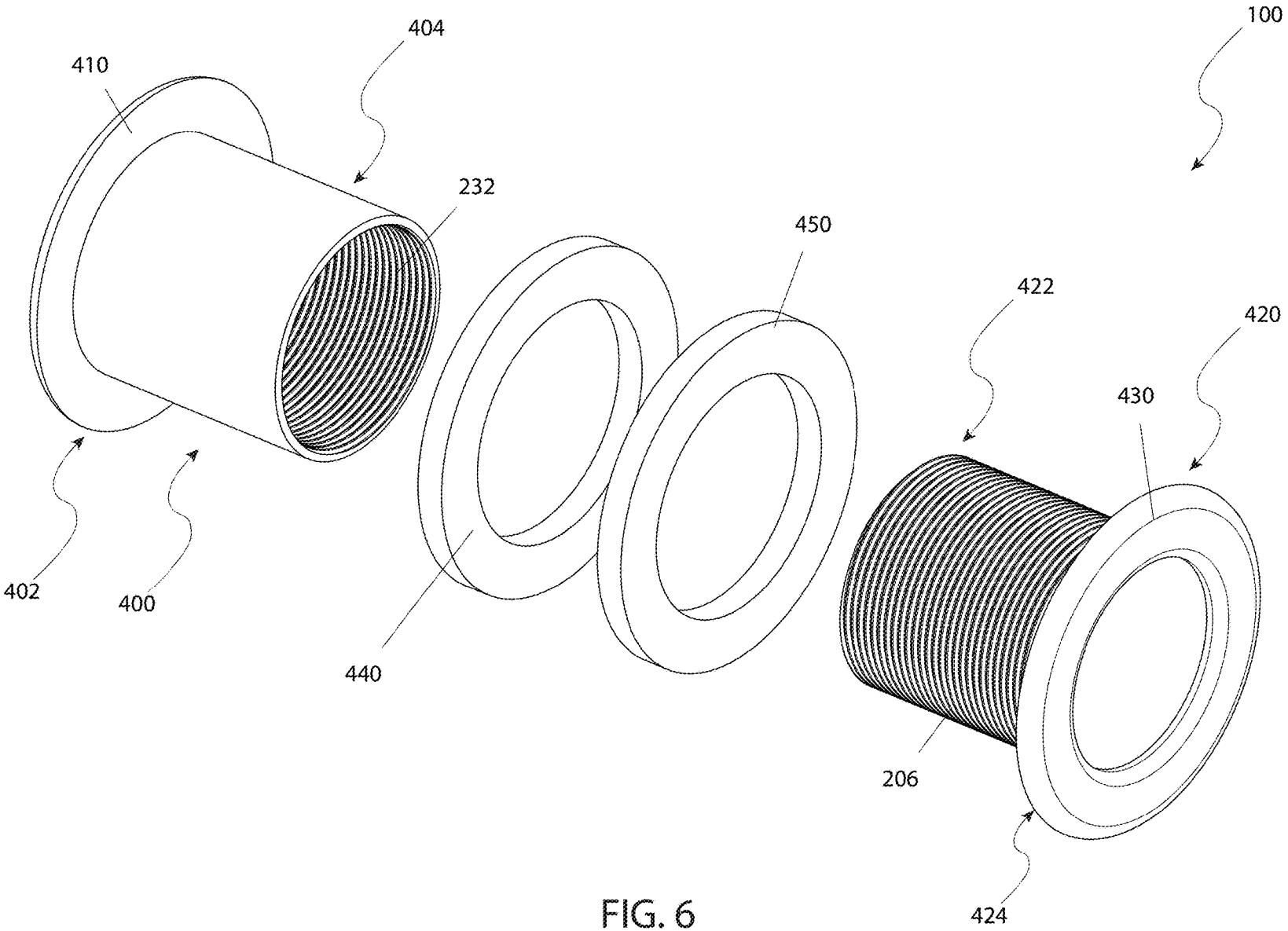

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, an overflow protection adapter (herein described as the "invention") and generally noted as 100, is shown according to a preferred embodiment of the present invention. The invention 100 may comprise a pipe nipple 200, a first nut 210, a second nut 220, a first seal 240, and a second seal 250. Alternately, an alternate overflow prevention adapter (herein described as the "alternate invention") 300 may comprise an alternate pipe nipple 400, a coupler 420, a third seal 440, and a fourth seal 450. The coupler 420 is linearly and selectively adjustable relative to the alternate pipe nipple 400. The invention 100 (or alternate invention 300) may be coupled to a double basin sink 900 such that the pipe nipple 200 (or alternate pipe nipple 400 and coupler 420) passes through a divider wall 930 between a first sink basin 910 and a second sink basin 920. The invention 100 (or alternate invention 300) may protect the double basin sink 900 from overflowing by diverting water 940 from the first sink basin 910 which is stopped into the second sink basin 920 which is unstopped, or by diverting the water 940 from the second sink basin 920 which is stopped into the first sink basin 910 which is unstopped. Overflow water 942 may drain from the double basin sink 900 via an unstopped basin 922 instead of overflowing the double basin sink 900.

The pipe nipple 200 may be a hollow cylindrical tube with a threaded first end 202 and a threaded second end 204. The pipe nipple 200 may be coupled to the divider wall 930 of the double basin sink 900 by passing the pipe nipple 200 through holes drilled in the divider wall 930. The pipe nipple 200 may be held in place by the first nut 210 and the second nut 220 which may couple to opposing ends of the pipe nipple 200. An individual end selected from the first end 202 and the second end 204 may comprise an external thread 206.

The first nut 210 may detachably couple to the first end 202 of the pipe nipple 200 and the second nut 220 may detachably couple to the second end 204 of the pipe nipple 200. The first nut 210 may be threadedly coupled to the pipe nipple 200 from the first sink basin 910 and the second nut 220 may be threadedly coupled to the pipe nipple 200 from the second sink basin 920.

Each first nut 210 and the second nut 220 may comprise a first side and a second side. The first nut 210 and second nut 220 may each comprise an internal thread 232 extending into the individual nut from the first side but stopping short of passing entirely therethrough. The internal thread 232 may complement the external thread 206 on the pipe nipple 200 such that the first nut 210 or second nut 220 may threadedly couple to the pipe nipple 200.

The second side may comprise a lip 234. The lip 234 may be a reduction of the inside diameter of the first nut 210 or second nut 220. The lip 234 may limit the insertion distance of the pipe nipple 200 and may hide the end of the pipe nipple 200.

The first nut 210 and second nut 220 may be visible within the double basin sink 900 and therefore may comprise a decorative appearance. As non-limiting examples, the first nut 210 and second nut 220 may comprise a color, finish, and/or form that visually blends with the double basin sink 900.

The first seal 240 may be coupled to the pipe nipple 200 at the first end 202, between the first nut 210 and the divider wall 930. The second seal 250 may be coupled to the pipe nipple 200 at the second end 204, between the second nut 220 and the divider wall 930. The first seal 240 and the second seal 250 may form a seal between the individual nut and the divider wall 930 such that the water 940 may only flow out of the double basin sink 900 via the pipe nipple 200. Specifically, the first seal 240 and the second seal 250 may prevent the water 940 from leaking through the divider wall 930 on the outside of the pipe nipple 200.

Referring now more closely to the alternate invention 300, the alternate pipe nipple 400 may be a hollow cylindrical tube with an alternate first end 402 and a threaded alternate second end 404. A first flange 410 circumscribes the terminal portion of the alternate first end 402. The alternate second end 404 may comprise an internal thread 232. The alternate pipe nipple 400 may be coupled to the divider wall 930 of the double basin sink 900 by passing the alternate second end 404 of the alternate pipe nipple 400 through holes drilled in the divider wall 930. The first flange 410 of the alternate pipe nipple 400 prevents the alternate pipe nipple 400 from full travel therein.

A coupler 420 may comprise a cylindrical rod or hollow structure having coupler first end 422 and a coupler second end 424. The coupler first end 422 may comprise an external thread 206 extending along a length of the coupler 420 and terminating prior to the terminal portion of the coupler second end 424. with the entire length of the coup. The external thread 206 may complement the internal thread 232 in the alternate pipe nipple 400 such that the coupler 420 may threadedly couple to the alternate pipe nipple 400. This coupling can be selectively adjustable depending on the effecting mating length of internal threads 232 of the alternate pipe nipple 400 and the external threads 206 of the coupler 420. This provides a more custom installation due to widths of the divider wall 930.

The coupler second end 424 may comprise a second flange 430. The second flange 430 circumscribes the terminal portion of the coupler second first end 424. The second flange 430 may limit the insertion distance of the coupler 420. The second flange 430 may be similar or identical in size, shape, and design as the first flange 410 as these are the portions of the alternate invention 300 that may be visible within the double basin sink 900. As non-limiting examples, the first flange 410 and second flange 430 may comprise a color, finish, and/or form that visually blends with the double basin sink 900.

The third seal 440 may be coupled to the alternate pipe nipple 400 at the alternate first end 402, between the first flange 410 and the divider wall 930. The fourth seal 450 may be coupled to the coupler 420 at the coupler second end 424, between the second flange 430 and the divider wall 930. The third seal 440 and the fourth seal 450 may form a seal between the first flange 410 and second flange 430, respectively, and to the divider wall 930 such that the water 940 may only flow out of the double basin sink 900 via the alternate pipe nipple 400 and coupler 430. Specifically, the third seal 440 and the fourth seal 450 may prevent the water 940 from leaking through the divider wall 930 on the outside of the alternate pipe nipple 400 and coupler 420.

As non-limiting examples, the first seal 240, second seal 250, third seal 440, and fourth seal 450 may be a washer or O-ring made of rubber, nylon, nitrile, neoprene, ethylene propylene, silicone, fluoroelastomers, or polytetrafluoroethylene (PTFE).

In some embodiments, the pipe nipple 200, alternate pipe nipple 400, the first nut 210, the second nut 220, the coupler 420 or any combination thereof may be made of plastic. As non-limiting examples, the pipe nipple 200, the alternate pipe nipple 400, the first nut 210, the second nut 220 and/or the coupler 420 may be made from polyvinyl chloride (PVC), chlorinated PVC (CPVC), acrylonitrile butadiene styrene (ABS), polyethylene (PE), high-density polyethylene (HDPE), polypropylene (PP), or any combination thereof.

2. Operation of the Preferred Embodiment

In use, the invention 100 may be installed by a user by:

Drilling through the divider wall 930. In a preferred embodiment, the hole for the invention 100 may be positioned approximately one and one-half inches (1½ in.) below the top of the divider wall 930 and on the rear of the basins 910, 920.

Sliding the pipe nipple 200 through the drilled hole such the first end 202 shows in the first sink basin 910 and the second end 204 shows in the second sink basin 920.

Placing the first seal 240 over the first end 202 of the pipe nipple 200 and placing the second seal 250 over the second end 204 of the pipe nipple 200.

Placing the first nut 210 over the first end 202 of the pipe nipple 200 and placing the second nut 220 over the second end 204 of the pipe nipple 200.

Tightening both the first nut 210 and the second nut 220.

In use, the alternate invention 300 may be installed by a user by:

Drilling through the divider wall 930. In a preferred embodiment, the hole for the alternate invention 300 may be positioned approximately one and one-half inches (1½ in.) below the top of the divider wall 930 and on the rear of the basins 910, 920.

Sliding the alternate pipe nipple 400 through the third seal 440 and then through the drilled hole such the first flange 410 of the alternate first end 402 shows in the first sink basin 910 and the alternate second end 404 shows in the second sink basin 920.

Coupling the coupler 420 to the alternate pipe nipple 400 by sliding the coupler first end 422 through the fourth seal 450 and then through the drilled hole such that the coupler first end 422 threadingly mates with the alternate second end 404 of the alternate pipe nipple 400 and the second flange 430 shows in the second sink basin 920.

Tightening the coupler 420 to the alternate pipe nipple 400.

Once installed, the first sink basin 910 may be stopped to retain water 940 and the second sink basin 920 may be unstopped. A tap may be turned on to run the water 940 into the first sink basin 910. If the level of the water 940 becomes elevated to the point where the water 940 reaches the bottom of the pipe nipple 200 (or alternate pipe nipple 400 and coupler 420), the water 940 may flow through the pipe nipple 200 (or alternate pipe nipple 400 and coupler 420) out of the first sink basin 910 and into the second sink basin 920. The water 940 may then flow into a drain in the second sink basin 920. A person of ordinary skill in the art will recognize that it may be the second sink basin 920 that is stopped and the first sink basin 910 may be unstopped and that the flow of water 940 may be out of the second sink basin 920 and into the first sink basin 910.

The exact specifications, materials used, and method of use of the invention 100 (or alternate invention 300) may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application. At least one specification heading is required.

The invention claimed is:

1. A device for preventing water overflow in double-sided sinks, comprising:

a hollow cylindrical pipe nipple with a first threaded end and a second threaded end;

a first plastic nut and a second plastic nut; and a first rubber O-ring and a second rubber O-ring;

wherein the first and second plastic nuts each comprise:

an internal thread extending from a first side of the nut but stopping short of passing entirely through the nut; and a lip on a second side of the nut, the lip comprising a reduction of the inside diameter of the nut;

wherein the pipe nipple is configured to be installed through a divider wall of a double-sided sink, with the first and second plastic nuts and the first and second rubber O-rings securing the pipe nipple in place and providing a watertight seal, thereby allowing excess water from one basin to flow into the other basin.

2. The device of claim 1, wherein the pipe nipple is made of a material selected from the group consisting of polyvinyl chloride (PVC), chlorinated PVC (CPVC), acrylonitrile butadiene styrene (ABS), polyethylene (PE), high-density polyethylene (HDPE), and polypropylene (PP).

3. The device of claim 1, wherein the first and second plastic nuts have an external surface designed to aesthetically blend with the sink.

4. The device of claim 3, wherein the external surface of the first and second plastic nuts comprises a color, finish, or form that visually complements the double-sided sink.

5. The device of claim 1, wherein the first and second rubber O-rings are made of a material selected from the group consisting of rubber, nylon, nitrile, neoprene, ethylene propylene, silicone, fluoroelastomers, and polytetrafluoroethylene (PTFE).

6. The device of claim 1, further comprising an adjustable coupler mechanism to accommodate various divider wall thicknesses, the adjustable coupler mechanism comprising:

an alternate pipe nipple with a first end having a first flange and a second end having an internal thread;

a coupler with a first end having an external thread and a second end having a second flange; and a third rubber O-ring and a fourth rubber O-ring;

wherein the coupler is configured to threadedly engage with the alternate pipe nipple, allowing for linear adjustment to accommodate different divider wall thicknesses.

7. The device of claim 6, wherein the alternate pipe nipple and the coupler are made of materials selected from the group consisting of PVC, CPVC, ABS, PE, HDPE, and PP.

8. A kit for preventing water overflow in double-sided sinks, comprising:

a hollow cylindrical pipe nipple with a first threaded end and a second threaded end;

a first plastic nut and a second plastic nut configured to engage with the threaded ends of the pipe nipple;

a first rubber O-ring and a second rubber O-ring;

instructions for installing the device in a double-sided sink; and a drill bit sized appropriately for creating a hole in a sink divider wall to accommodate the pipe nipple.

9. The kit of claim 8, further comprising an adjustable coupler mechanism including:

an alternate pipe nipple with a first end having a first flange and a second end having an internal thread;

a coupler with a first end having an external thread and a second end having a second flange; and a third rubber O-ring and a fourth rubber O-ring.

10. The kit of claim 8, further comprising a sealant compound for ensuring a watertight seal between the device components and the sink divider wall.

* * * * *